US007524797B1

(12) United States Patent
Perez, Jr. et al.

(10) Patent No.: US 7,524,797 B1
(45) Date of Patent: Apr. 28, 2009

(54) LOW VOLATILE ORGANIC CONTENT LUBRICANT

(75) Inventors: Aureliano Perez, Jr., Austin, TX (US); Kenneth A. Vaught, Austin, TX (US); George P. Hansen, Austin, TX (US)

(73) Assignee: Texas Research International, Inc., Austin, TX (US)

( * ) Notice: Subject to any disclaimer, the term of this patent is extended or adjusted under 35 U.S.C. 154(b) by 339 days.

(21) Appl. No.: 11/032,398

(22) Filed: Jan. 10, 2005

Related U.S. Application Data

(60) Provisional application No. 60/592,174, filed on Jul. 29, 2004.

(51) Int. Cl.
*C10M 169/04* (2006.01)
*C10M 125/22* (2006.01)
*C10M 111/04* (2006.01)

(52) U.S. Cl. ..... 508/168; 508/181; 508/118

(58) Field of Classification Search ..... 508/168, 508/181, 118
See application file for complete search history.

(56) References Cited

U.S. PATENT DOCUMENTS

| | | | | |
|---|---|---|---|---|
| 4,452,712 | A * | 6/1984 | Laemmle | 508/495 |
| 4,828,729 | A | 5/1989 | Centers | 252/25 |
| 5,108,629 | A * | 4/1992 | Matsuda et al. | 508/468 |
| 5,262,074 | A | 11/1993 | Erickson et al. | 252/49.003 |
| 5,356,545 | A | 10/1994 | Wayte | 252/28 |
| 5,393,440 | A | 2/1995 | Roller et al. | 252/25 |
| 5,427,698 | A * | 6/1995 | Hirokawa et al. | 508/106 |
| 5,482,637 | A | 1/1996 | Rao et al. | 252/29 |
| 5,549,836 | A * | 8/1996 | Moses | 508/183 |
| 5,704,749 | A * | 1/1998 | Landgrebe | 411/366.2 |
| 5,958,847 | A | 9/1999 | Novak | 508/156 |
| 5,998,527 | A * | 12/1999 | Giunta | 524/431 |
| 6,194,357 | B1 * | 2/2001 | Murata et al. | 508/113 |
| 6,455,476 | B1 * | 9/2002 | Imai et al. | 508/156 |
| 2003/0224947 | A1 | 12/2003 | Naik et al. | 508/121 |
| 2004/0248744 | A1 * | 12/2004 | King et al. | 508/437 |
| 2005/0215678 | A1 * | 9/2005 | Ludtke et al. | 524/127 |

* cited by examiner

*Primary Examiner*—Glenn Caldarola
*Assistant Examiner*—Jim Goloboy
(74) *Attorney, Agent, or Firm*—O'Keefe, Egan, Peterman & Enders, LLP

(57) ABSTRACT

A water-based lubricant composition, comprising: water, molybdenum disulfide, polytetrafluoroethylene, and a polymeric binder, wherein the binder is an acrylic resin or a polyurethane resin.

53 Claims, No Drawings

LOW VOLATILE ORGANIC CONTENT LUBRICANT

This application claims priority to provisional patent application Ser. No. 60/592,174, filed Jul. 29, 2004, incorporated by reference in its entirety.

BACKGROUND OF INVENTION

This invention pertains to a water-based dry film lubricant composition that has a low volatile organic content (VOC).

Many dry film lubricants have been developed. These lubricants are used on metal parts for antigalling, antifretting, antisiezing, and assembly aid applications. However, much research has been conducted to replace dry film lubricants that are applied with potentially hazardous solvents, including lead-containing lubricants. Of particular interest in many military applications are new dry lubricants that are water-based, and which provide both corrosion resistance and lubricating properties. Until now no composition has met certain stringent military requirements such as those in U.S. military specification MIL-L-23398 for both lubricating and anticorrosive properties.

SUMMARY OF INVENTION

The present invention provides a solution to one or more of the disadvantages and deficiencies described above. This invention includes a composition that is water-based, has a low VOC content, and provides both lubricating and anticorrosive properties to metal surfaces on which the composition is applied. Advantageously, the composition can meet the current military requirements under U.S. military specification MIL-L23398 for both lubricating and anticorrosive properties. The composition is useful as a dry film lubricant for antigalling, antifretting, antisiezing, and assembly aid applications on a variety of surfaces such as those made of, for example, steel, aluminum, titanium, and so forth. The formulation provides both lubricating and corrosion protection.

In one broad respect, this invention is a water-based lubricant composition, comprising: water, molybdenum disulfide, polytetrafluoroethylene, and a polymeric binder, wherein the binder is an acrylic resin or a polyurethane resin. The composition is in the form of a dispersion when used. It should be appreciated that the molybdenum disulfide may settle out if allowed to stand undisturbed.

In another broad respect, this invention is a water-based lubricant composition, comprising: 20 to 60 percent of water, 0.1 to 50 percent of molybdenum disulfide, 0.1 to 10 percent polytetrafluoroethylene, 5 to 50 percent of an aliphatic polyurethane binder, 0.1 to 10 percent of a nitrogen-containing basic compound selected from the group consisting of ammonia, diethanol amine, triethanol amine, morpholine, or a combination thereof, at least one glycol ether coalescing agent, wherein the composition has a pH in the range from 8 to 10.

In another broad respect, this invention is a process for the manufacture of a water-based lubricant composition, comprising: combining water, molybdenum disulfide, polytetrafluoroethylene, and a polymeric binder to form the water-based lubricant composition, wherein the binder is an acrylic resin or a polyurethane resin.

In another broad respect, this invention is a process of coating a metal surface with a lubricant, comprising: applying a water-based lubricant composition to the metal surface, wherein the water-based composition comprises water, molybdenum disulfide, polytetrafluoroethylene, and a polymeric binder, wherein the binder is an acrylic resin or a polyurethane resin; and allowing water and any volatile components of the water-based lubricant composition to evaporate to thereby form a coating on the metal surface.

In another broad respect, this invention is a metal fastener coated with the residue formed by evaporation of volatile components of a water-based composition comprising water, an acrylic or urethane resin, molybdenum disulfide, and polytetrafluoroethylene.

The lubricant composition forms a coating upon curing and/or evaporation of the volatile components. The lubricant composition of this invention is stable, provides a stable film upon application, and provides both corrosion resistance and lubricity to the surface on which the coating is applied.

This invention has a number of advantages. Importantly, the water-based composition provides both corrosion resistance and lubricity to the metal surface on which the composition is applied. Likewise, the composition has a low VOC. The composition is also easily applied. Then too, after being applied to a metal surface, the volatile components evaporate readily and such that the binder forms a consistent coating.

DETAILED DESCRIPTION OF THE INVENTION

The composition of this invention comprises water, a binder, molybdenum disulfide, polytetrafluoroethylene, and may contain additional optional components.

The composition of this invention includes water. In one embodiment, the water is deionized water. The composition includes from about 1 to about 90 percent by weight of water. In one embodiment, the composition contains from about 20 to about 60 percent by weight of water. In another embodiment the composition contains water in an amount from about 25 to about 50 percent by weight.

The binder employed in the practice of this invention is an acrylic resin or a polyurethane resin or both. Both acrylic resins and the polyurethane resins are well known. In one embodiment, the binder is an aliphatic polyurethane resin, such as a high solids aliphatic polyurethane dispersion. A representative example of a suitable, commercially available aliphatic polyurethane resin is JONCRYL U4188, which is high (38% by weight) solids aliphatic polyurethane dispersion in water and co-solvent (methyl-2-pyrrolidone and triethylamine), which is designed for abrasion, mar and water resistance alone or in combination with acrylic resins. Additional representative examples of a commercially available polyurethane resin binder include HYBRIDUR 541 urethane-acrylic hybrid polymer and HYBRIDUR 570 urethane-acrylic hybrid polymer which are available from Air Products and Chemicals, Inc., JONCRYL U4100 waterborne aliphatic polyurethane dispersion (33% solids) available from Johnson Polymer, Inc., JONCRYL 1550 acrylic emulsion, MACEKOTE 8539 aliphatic polyester based aqueous polyurethane, MACEKOTE 5218 fully reacted aliphatic polyurethane supplied as a fine particle size dispersion in water and co-solvent, MACEKOTE 8538 aliphatic polyester based polyurethane in water, HAUTHANE HD-2107 aliphatic, polyester-based aqueous polyurethane dispersion, HAUTHANE HD-2503 polycarbonate-diol based, aliphatic, waterborne polyurethane, and SPENSOL F97-MPW-33 which is a waterborne oil modified urethane dispersion. The amount of binder used can vary widely depending for example on the application. It should be appreciated that the greater the proportion of resin employed relative to the molybdenum disulfide, the greater the corrosion resistance of the resulting cured film with, typically, a reduction in lubricity endurance of the system. In general, the amount of binder used is in the range of from about 5 to about 50 percent by weight of the composition.

The friction reducing compounds used in this invention include fluorinated polymers and molybdenum disulfide. The fluorinated polymers include materials such as polytetrafluoroethylene. The polytetrafluoroethylene reduces friction at low pressure, with the molybdenum disulfide providing excellent friction reduction at higher pressures during use. The amount of fluorinated polymers is generally from about 0.1 to 10 percent by weight of the total composition. Typically, the amount of fluorinated polymer is about 3 to about 7 percent. In one embodiment, the amount of fluorinated polymer employed is about 5 percent. In general, the molybdenum disulfide used in the practice of this invention has an average particle size in the range from 0.1 to 100 microns, in one embodiment from 0.1 to 50 microns, and in another embodiment from 1 to 10 microns. In one particular embodiment, the molybdenum disulfide has an average particle size of about 5 microns, containing particles in the range from 0.2 to 10 microns. The amount of molybdenum disulfide used is generally about 0.1 to about 50 percent by weight, and in one embodiment from 15 to 50 percent. Typically, the amount of molybdenum disulfide is from about 15 to about 30 percent. In one embodiment, the amount of molybdenum disulfide is from about 15 to 25 percent by weight. In one embodiment, the amount of molybdenum disulfide is about 21 percent by weight. The composition may optionally include other friction reducing compounds.

A surfactant can be optionally employed in the practice of this invention. The surfactant serves to suspend the friction reducing agents in the composition to thereby form a dispersion prior to application on the surface to be treated. A wide variety of surfactants can be employed. Non-limiting examples of representative surfactants which may optionally be used in the practice of this invention include non-ionic, anionic, cationic and amphoteric surfactants, such as monocarboxyl cocoimidoazoline, higher alkyl sulfate sodium salts, tridecyloxy poly(alkyleneoxy ethanol), ethoxylated or propoxylated alkyl phenol, alkyl sulfonamides, $C_{10-18}$ alkaryl sulfonates such as alkylbenzene sulfonates, cocoamphaodipropionate, cetylpalmitic alkanol amides, hydrogenated castor oil, isooctylphenyl polyethoxy ethanol, sorbitan monopalmitate, $C_{8-18}$ alkyl pyrrolidone, cocoaminopropionic acid and polyethoxy amino salts thereof. One representative class of useful surfactants are the ENVIROGEM AE surfactants (Air Products and Chemicals, Inc.) such as the AE-01 surfactant, which is an ester based, biodegradable, surfactant blend and is a low foam dispersing/wetting agent that reduces the surface tension of the formulation. The amount of surfactant is any amount effective to provide reduced surface tension of the formulation. In general the amount is about 0.1 to 5 percent by weight. In one embodiment, the amount is about 0.1 to 1 percent by weight. In one specific embodiment the amount is about 0.5 percent by weight.

The coalescing agents used in this invention include a variety of glycol based compounds, including the ethylene and propylene derived glycol ether types. In general, the preferred coalescing agents are the propylene glycol ethers. Representative nonlimiting examples of such coalescing agents include diethylene glycol n-butyl ether (DB), ethylene glycol n-butyl ether (EB), ethylene glycol phenyl ether (EPh), and propylene glycol n-propyl ether (PnP), propylene glycol phenyl ether (PPh), propylene glycol n-butyl ether (PnB), tripropylene glycol methyl ether (TPM), dipropylene glycol n-butyl ether (DPnB), tripropylene glycol n-butyl ether (TPnB), and dipropylene glycol methyl ether (DPM). Combinations of coalescing agents can be used in the practice of this invention, such as a combination of DPnB and TPM. The amount of coalescing agent used can vary widely. In general, the coalescing agent or mixture of agents is employed in an amount of from 1 to 20 percent by weight of the total formulation. In one embodiment, the amount is from 5 to 15 percent by weight.

A nitrogen-containing basic compound is employed to adjust the pH of the system if needed. In general, the composition has a pH in the range from 7 to 11, in one embodiment from 7.5 to 10.5, in one embodiment from 7 to 10, and in one embodiment from 8 to 10. It has been found that if the pH is unduly low, the formulation will be unstable or will not form a dispersion in the first instance. The pH is adjusted to a value of from 7 to 11 prior to introduction of the resin into the composition. It should be appreciated that molybdenum disulfide as received may impart acidity to the composition, which may require addition of base so that the resin remains stable. Owing to its basicity and low cost, ammonia is the preferred nitrogen-containing basic compound. In principle, any generally water soluble amine can be used. Representative examples of such amines include morpholine and triethanolamine. The nitrogen containing basic compound is added in an amount to provide the water-based composition with a pH of at least 7, in one embodiment at least 8, and in another embodiment a pH in the range from 7 to 9. When used, the amount of nitrogen-containing basic compound is generally at least about 0.1 percent by weight, in one embodiment at least about 0.2 percent, in one embodiment less than 10 percent, in one embodiment less than 5 percent, in one embodiment less than 1 percent, and in another embodiment about 0.3%.

The composition of this invention may optionally include one or more dispersing agents, which may be referred to as wetting agents. If used, the dispersing agent is typically present in an amount of from 0.01 to 10 percent by weight, typically from 0.05 to 7.5 percent by weight of the composition. Dispersing agents that may be suitable for use in this invention include crude tall oil, oxidized crude tall oil, surfactants, organic phosphate esters, modified imidazolines and amidoamines, siloxanes, alkyl aromatic sulfates and sulfonates. Representative examples of such wetting agents include but are not limited to sodium bis(tridecyl) sulfosuccinate, di(2-ethyl hexyl) sodium sulfosuccinate, sodium dihexylsulfosuccinate, sodium dicyclohexyl sulfosuccinate, diamyl sodium sulfosuccinate, sodium iso-butyl sulfosuccinate, disodium iso-decyl sulfosuccinate, disodium ethoxylated alcohol half ester of sulfosuccinic acid disodium alkyl amido polyethoxy sulfosuccinate, tetra-sodium N-(1,2-dicarboxyethyl)-N-octadecyl sulfosuccinamate, disodium N-octasulfosuccinamate, sulfated ethoxylated nonylphenol, 2-amino-2-methyl-1-propanol, the condensation product of formaldehyde with naphthalene sulphonate, an alkylarylsulphonate, a lignin sulphonate, a fatty alkyl sulphate, ethoxylated alkylphenol, and an ethoxylated fatty alcohol. Representative examples of commercially available dispersing agents include but are not limited to DISPERSBYK product which is a solution of alkanolammonium salt of a lower molecular weight polycarboxylic acid polymer and DISPERBYK 190 product which is a high molecular weight block copolymer with pigment affinic groups, BYK 346 and BYK 348 which are polyether modified dimethylpolysiloxanes, and BYK 028 which is a mixture of hydrophobic solids and foam destroying polysiloxanes in polyglycol.

The composition of this invention may optionally include one or more antifoam agents. If used, the antifoam agent is typically present in an amount of from 0.01 to 1 percent by weight, typically from 0.01 to 0.1 percent by weight. The antifoams may be based on fatty alcohols, fatty acids, silicone, hydrophobic silicon, ethylene-bis-stearamide, polyalkylene glycols, and fatty quaternary amine salts. Representative commercially available examples of such antifoaming agents include FOAMBAN 247 (Ultra Additives), FOAMBAN MS-575, BYK 028 which is a mixture of hydrophobic solids and foam destroying polysiloxanes in polyglycol, and BYK 346 and 348 which are polyether modified dimethylpolysiloxane solutions.

The composition of this invention typically provides a clear topcoat. However, the composition of this invention may optionally include a wide range of pigment choices.

The water-based composition can be prepared by combining the components together, with mixing, stirring, or other agitation. Because molybdenum disulfide will settle out if the water-based composition is allowed to set for an extended period of time, the composition should be shaken, stirred, or otherwise agitated to form a dispersion prior to use, with the molybdenum disulfide particles suspended in the composition.

The formulation of this invention can be applied to the surface to be treated in a variety of ways. For example, the formulation can be rolled, brushed, or sprayed onto the surface. Alternatively, the surface to be treated can be dipped into the formulation. For many applications, spray application is preferred.

After application, the water and coalescing agents will evaporate to leave a friction reducing coating. In general, after application, the treated surface is in a location having a temperature of over 0 degree Centigrade and less than 50 degrees Centigrade. Typically, the temperature is the ambient temperature (assuming the temperature is above the freezing point of water). The applied water-based composition can be heated to expedite coating formation, but this is not necessary and may be detrimental if the temperature is too high. Thus, evaporation of the water and any other volatile components, including coalescing agents, typically occurs at room temperature though elevated temperatures may be employed so long as an adequate coating forms. The surface can be treated with multiple coatings of the formulation to build up the thickness of the coating. The coating thickness can vary widely. In general the coating thickness is from about 1 micron to about 1 centimeter in depth. In one embodiment, the coating thickness is 0.0005 inch. After application, depending on the circumstances, it may be desirable to allow up to a full day to dry to allow the coating to fully cure.

The solid surfaces to be treated include metal surfaces such as alloys of steel, aluminum or titanium. Other surfaces can also be treated, however, such as ceramics. In one embodiment, the surface to be treated is a metal fastener such as a metal bolt, stud, screw, and nut.

The following examples are illustrative of this invention and are not intended to limit the scope of the invention or claims hereto. Unless otherwise denoted all percentages are by weight.

EXAMPLE 1

A dry film lubricant formulation was prepared. The formulation contained the following components, which were added in the order shown to improve stability of the system:

De-ionized water—40.2%
Ammonia—0.3%
JONCRYL U-4188 resin—22%
Molybdenum disulfide—21%
Surfactant (ENVIROGEM AE-01)—0.5%
Tripropylene glycol monomethyl ether (TPM)—6%
Dipropylene glycol butyl ether (DPnB)—5%
Polytetrafluoroethylene—5%

The water serves as the diluent/carrier for the formulation. The ammonia is present to reduce the acidity of the formulation. It is possible that if the molybdenum disulfide is treated to reduce its acidity as received from the manufacturer, it may be possible to omit the ammonia from the formulation. It is also possible that amines such as morpholine, triethanolamine and so on could be substituted for the ammonia. It has been found that the molybdenum disulfide will not go into the dispersion unless the resin is present. The JONCRYL resin is an aliphatic polyurethane dispersion. The surfactant lowers the surface tension of the coating as applied so that the surface is coated evenly. The TPM and DPnB are coalescing agents to provide an improved evaporation rate to enhance the coating performance. The coalescing agents can also serve to have secondary effects such as allowing flow and leveling to wet steel, lower surface tension, and provide defoaming properties. The polytetrafluoroethylene is provided as a fine powder, which provides lubricity at relatively low pressure, with the molybdenum disulfide providing excellent lubricity at higher pressures.

The formulation was tested on surfaces. In particular, the formulation was tested for film adhesion using ASTM D 2510, Procedure A, resistance to fluid using ASTM D 2510, Procedure C, thermal shock sensitivity using ASTM D 2511, endurance life using ASTM D 2625, Procedure A, loading carrying capacity using ASTM D 2625, Procedure B. The coating demonstrated excellent resistance to the selected fluids (Castrol 5050, MIL-H-83282 hydraulic fluid, MIL-C-372 cleaning fluid, MIL-L-2104 lubricating oil, 1,1,1-trichloroethane, JP-4, MIL-A-8243 de-icing fluid, reagent water), did not blister, flake or peel, and no visible amount of coating was removed by the adhesive tape. The formulation passed all of these tests. The formulation also had an acceptable endurance life for MIL-L-23398 Type I.

EXAMPLE 2

This example shows formulations where glycol ether co-solvents were and were not used. The amounts are in grams.

| | 2A | 2B | 2C | 2D | 2E |
|---|---|---|---|---|---|
| HYBRIDUR 541 resin | 90 | 75 | 55 | 75 | 75 |
| ARCOSOLV DPnB | 0 | 7.5 | 5 | 14 | 14 |
| ARCOSOLV TPM | 0 | 7.5 | 5 | 0 | 0 |
| FLUOROLINK | 0 | 0 | 25 | 0 | 25 |
| Deionized water | 10 | 10 | 10 | 10 | 10 |

In formulation 2C, FLUOROLINK was added to impart a slip agent into the polymer system. The formulations were spray applied to MYLAR sheets using an HVLP spray gun. After about two hours of room temperature cure the products all formed a film. However, for formulations 2A, 2D, and 2E, each film appeared to be made up of small droplets, and it appeared that the droplets did not flow or level as efficiently as fully formed coating systems.

EXAMPLE 3

Based on Example 2, it was reasoned that a waterborne dry film lubricant may be prepared from a waterborne polymer binder and slip additives (PTFE, FLUROLINK, mica, and so on). The following table shows formulations made using a waterborne acrylic polymer as the binder and FLUROLINK as the slip additive. The amounts are in grams.

| | 3A | 3B | 3C |
|---|---|---|---|
| JONCRYL 2561 | 90 | 64 | 64 |
| FLUOROLINK | 0 | 25 | 25 |
| BYK 348 | 0 | 1 | 1 |
| ARCOSOLV DPnB | 0 | 0 | 10 |
| Deionized water | 10 | 10 | 24 |

The formulations were prepared and sprayed applied to a MYLAR sheet. It was observed that addition of DPnB to JONCRYL 2561 caused a rapid increase in the viscosity of the dispersion. An increase in the water level was necessary for formulation 3C to reduce the viscosity of the formulation to a sprayable viscosity.

EXAMPLE 4

In this example, JONCRYL U4188 urethane resin dispersion was used. The following table shows the formulations prepared. All amounts are in grams.

| | 4A | 4B | 4C | 4D |
|---|---|---|---|---|
| JONCRYL U4188 | 80 | 64.55 | 59.55 | 54.55 |
| ARCOSOLV DPnB | 0 | 7.5 | 7.5 | 7.5 |
| ARCOSOLV TPM | 0 | 7.5 | 7.5 | 7.5 |
| Deionized water | 20 | 20 | 20 | 20 |
| FOAM BAN MS-575 | 0 | 0.05 | 0.05 | 0.05 |
| BYK 348 | 0 | 0.1 | 0.1 | 0.1 |
| FLUOROLINK | 0 | 0 | 0 | 5 |
| Boron nitride | 0 | 0 | 5 | 5 |

The formulations were prepared and sprayed onto a MYLAR sheet. Formulation 4A, which lacked the coalescing agents, did not flow and level properly. Formulation 4B formed a translucent and good abrasion resistance film based on a simple thumbnail rub. Formulation 4C formed a well dispersed film with no agglomerations, reduced surface tack, and had slightly less structural integrity than formulation 4B. Formulation 4D formed a film similar in appearance to formulation 4C, with good abrasion resistance.

EXAMPLE 5

In this example, HYBRIDUR 570 urethane dispersion was used as the resin in formulations using slip additives. The formulations prepared are shown in the following table. In the table, all amounts are in grams.

| | 5A | 5B | 5C | 5D |
|---|---|---|---|---|
| HYBRIDUR 570 | 79 | 78.05 | 68.05 | 53.05 |
| Deionized water | 10 | 10 | 10 | 10 |
| ARCOSOLV DPnB | 5 | 5 | 5 | 5 |
| ARCOSOLV TPM | 5 | 5 | 5 | 5 |
| BYK 346 | 1 | 1 | 1 | 1 |
| FOAM BAN 247 | 0 | 0.05 | 0.5 | 0.5 |
| Mica | 0 | 0 | 10 | 25 |

The formulations were prepared and spray applied. Formulation 5C did not foam when mixed under high shear. Formulation 5C flowed and leveled properly over a freshly sandblasted steel panel. After air drying for about 30 minutes, the film showed signs of air bubbles and/or mica agglomeration on the surface. The mixed product showed signs of the mica forming agglomerations after a short period of time (30 minutes).

EXAMPLE 6

Additional formulations were prepared employing JONCRYL U4188 as the resin. The formulations are provided in the following table. In the table, all amounts are in grams.

| | 6A | 6B | 6C |
|---|---|---|---|
| First components | | | |
| JONCRYL U4188 | 12.35 | 12 | 12 |
| ARCOSOLV DPnB | 5 | 7 | 6 |
| ARCOSOLV TPN | 5 | 7 | 6 |
| FOAM BAN 247 | 0.05 | 0.05 | 0.05 |
| BYK 346 | 1 | 1 | 1 |
| Deionized water | 15 | 11.35 | 9.35 |
| Second components | | | |
| DISPERBYK | 1.5 | 1.5 | 1.5 |
| molybdenum sulfide | 15 | 13 | 11 |
| FOAM BAN 247 | 0.1 | 0.1 | 0.1 |
| Deionized water | 35 | 39 | 42 |
| Boron nitride | 10 | 8 | 7 |

In this example, the second components were mixed, with boron nitride added last. The first components were mixed, with JONCRYL U 4188 being added last.

The formulations were prepared and spray applied to a MYLAR sheet. Formulation 6A was too viscous for spraying, so water was added in nine 5 gram increments to reduce viscosity to a sprayable composition. After dilution, the coating formed agglomerations upon spraying. Formulation 6B was also viscous and needed water to reduce viscosity. The diluted formulation 6B was not spray applied. Formulation 6C was spray applied after dilution with tap or DI water onto a pin and V-block test that is similar to a commercial apparatus used for ASTM D2625-94, which performed better than PERMA-SLIK G coating.

EXAMPLE 7

Three aliphatic urethane dispersion resins were tested in place of the material used in Example 6, Formulation 6A. The formulations are provided in the following table. In the table, all amounts are in grams.

| | 7A | 7B | 7C |
|---|---|---|---|
| Part A | | | |
| MACEKOTE 5218 | 12.35 | 0 | 0 |
| MACEKOTE 8538 | 0 | 12.35 | 0 |
| MACEKOTE 8539 | 0 | 0 | 12.35 |
| DPnB | 5 | 5 | 5 |
| TPM | 5 | 5 | 5 |
| BYK 346 | 1 | 1 | 1 |
| FOAM BAN 247 | 0.05 | 0.05 | 0.05 |
| SILANE A-1106 | 0.08 | 0.08 | 0.08 |
| Deionized water | 16 | 16 | 16 |
| Part B | | | |
| Deionized water | 48.6 | 48.6 | 48.6 |
| DISPERBYK | 1 | 1 | 1 |
| Molybdenum disulfide | 11 | 11 | 11 |

The formulations were made by preparing a master batch of the Part B for a given formulation, followed by addition of the resin and balance of Part A. The pH of Part A for formulation 7A was 8.78, for formulation 7B was 8.68, and for formulation 7C was 8.94. For all three formulations, the molybdenum disulfide solidified upon mixing with Part A. The example shows that the pH of the system may be important if molybdenum disulfide is used.

EXAMPLE 8

In an effort to improve the stability of the molybdenum disulfide, the order of addition of the components was tested in this example. The formulations are provided in the following table. In the table, all amounts are in grams.

| | 8A | 8B |
|---|---|---|
| JONCRYL U4188 | 12.35 | 12.35 |
| Deionized water | 64.6 | 64.6 |
| DISPERBYK | 1 | 1 |
| BYK 346 | 1 | 1 |
| FOAMBAN 247 | 0.05 | 0.05 |
| DPnB | 0 | 5 |
| TPM | 0 | 5 |

Formulation 8A was somewhat whipped with air, but did not separate overnight at room temperature. The viscosity of the mixture was low enough to spray out of spray gun. Agglomerations were not visible and did not appear when the product was drawn down or sprayed onto a metal flat panel. For formulation 8B, liquid phase separation occurred quickly. It appeared to be the co-solvent rising above the bulk of the mixture. Small agglomerations were present in the bottom of the mix container, and were visible on the surface of a metal panel that formulation 8B was drawn down to.

It should be appreciated that the greater the amount of resin, the better the corrosion resistance. By contrast, increasing the amount of molybdenum disulfide leads to a longer wear life.

EXAMPLE 9

Several formulations were prepared to determine whether the co-solvent caused instability of the formulation system. Different resins were also tested. The formulations are provided in the following table. In the table, all amounts are in grams.

| | 9A | 9B | 9C | 9D | 9E | 9F |
|---|---|---|---|---|---|---|
| HAUTHANE HD-2503 | 12.5 | 0 | 0 | 0 | 0 | 0 |
| HAUTHANE HD-2107 | 0 | 12.5 | 0 | 0 | 0 | 0 |
| MACEKOTE 8539 | 0 | 0 | 12.5 | 0 | 0 | 0 |
| MACEKOTE 5218 | 0 | 0 | 0 | 12.5 | 0 | 0 |
| MACEKOTE 8538 | 0 | 0 | 0 | 0 | 12.5 | 0 |
| HYBRIDUR 541 | 0 | 0 | 0 | 0 | 0 | 12.5 |
| Deionized water | 75 | 75 | 75 | 75 | 75 | 75 |
| Molybdenum disulfide | 11 | 11 | 11 | 11 | 11 | 11 |
| DISPERBYK | 1 | 1 | 1 | 1 | 1 | 1 |
| BYK 346 | 1 | 1 | 1 | 1 | 1 | 1 |
| FOAMBAN 247 | 0.05 | 0.05 | 0.05 | 0.05 | 0.05 | 0.05 |

All formulations formed whipped products with some elevated viscosity. The mixed formulations were de-gassed under vacuum, which reduced the volume and viscosity. Formulations 9A and 9C sprayed well. Formulation 9B sprayed well with intermittent clogging. Formulations 9D and 9E sprayed reasonably well, but were close to the spray limit for viscosity. Formulation F sprayed well, with slight pulses.

EXAMPLE 10

This example examines the incorporation of boron nitride, PTFE powder, and liquid fluoropolymer. The formulations are provided in the following table. In the table, all amounts are in grams.

| | 10A | 10B | 10C |
|---|---|---|---|
| Deionized water | 75 | 75 | 75 |
| FOAMBAN 247 | 0.05 | 0.05 | 0.05 |
| DISPERBYK 190 | 4.5 | 4.5 | 4.5 |
| Molybdenum disulfide | 16 | 16 | 16 |
| BYK 346 | 1 | 1 | 1 |
| Methyl ethyl amine (MEA) | 0.2 | 0.6 | 0.6 |
| JONCRYL U4188 | 12.5 | 12.5 | 12.5 |
| Boron nitride | 10 | 0 | 0 |
| PTFE powder | 0 | 10 | 0 |
| FOMBLIN FE-200[a] | 0 | 0 | 5 |

[a]FOMBLIN FE-200 is a mixture of perfluoropolyoxyalkane-carboxylate of triethanol amine or trifluoromethyl ketone, butyl alcohol, and water.

The pH of the formulations were as follows: 10A, 8.34; 10B, 8.3; and 10C, 8.4. Formulation 10A agglomerated when the JONCRYL U4188 was added to the mixture. Based on the results, it was decided to run tests using pre-neutralization with MEA prior to resin addition. Formulations 10B and 10C formed a stable composition which formed a homogenous film.

EXAMPLE 11

This example examines pH modifications to formulations by incorporating morpholine and/or MEA, with the goal of achieving a pH of 8-9 in the final formulation.

| | pH after addition of each component for formulation 11A | 11A | pH after addition of each component for formulation 11B | 11B |
|---|---|---|---|---|
| Deionized water | 5.8 | 70 | 5.4 | 70 |
| FOAMBAN 247 | 5.8 | 0.05 | 4.82 | 0.05 |
| DISPERBYK 190 | 3.5 | 4.5 | 3.41 | 4.5 |
| Molybdenum disulfide | 2.0 | 16 | 1.98 | 16 |
| Morpholine | 8.45 | 0.4 | N/A | 0 |
| MEA | N/A | 0 | 8.39 | 0.25 |
| BYK 346 | 8.36 | 1 | 8.26 | 1 |
| JONCRYL U4188 | 8.48 | 12.5 | 8.27 | 12.5 |

The resulting formulations had the pH values as shown in the table and were stable after addition of the resin.

EXAMPLE 12

Various resins were tested for chemical resistance to jet fuel. The formulations are provided in the following table. In the table, all amounts are in grams.

| | 12A | 12B | 12C | 12D | 12E | 12F | 12G | 12H | 121 | 12J |
|---|---|---|---|---|---|---|---|---|---|---|
| DI water | 70 | 70 | 70 | 70 | 70 | 70 | 70 | 70 | 70 | 70 |
| FOAMBAN 247 | 0.05 | 0.05 | 0.05 | 0.05 | 0.05 | 0.05 | 0.05 | 0.05 | 0.05 | 0.05 |
| DISPERLYK 190 | 4.5 | 4.5 | 4.5 | 4.5 | 4.5 | 4.5 | 4.5 | 4.5 | 4.5 | 4.5 |
| Molybdenum disulfide | 16 | 16 | 16 | 16 | 16 | 16 | 16 | 16 | 16 | 16 |
| Morpholine | 0.25 | 0.25 | 0.25 | 0.25 | 0.25 | 0.25 | 0.25 | 0.25 | 0.25 | 0.25 |
| BYK 346 | 1 | 1 | 1 | 1 | 1 | 1 | 1 | 1 | 1 | 1 |
| JONCRYL U4188 | 12.5 | 0 | 0 | 0 | 0 | 0 | 0 | 0 | 0 | 0 |
| JONCRYL U4100 | 0 | 12.5 | 0 | 0 | 0 | 0 | 0 | 0 | 0 | 0 |
| HYBRIDUR 570 | 0 | 0 | 12.5 | 0 | 0 | 0 | 0 | 0 | 0 | 0 |
| HYBRIDUR 541 | 0 | 0 | 0 | 12.5 | 0 | 0 | 0 | 0 | 0 | 0 |
| REICHHOLD SPENSOL F-97-MPW-3 | 0 | 0 | 0 | 0 | 12.5 | 0 | 0 | 0 | 0 | 0 |
| HAUTHANE HD-2503 | 0 | 0 | 0 | 0 | 0 | 12.5 | 0 | 0 | 0 | 0 |
| HAUTHANE HD 2107 | 0 | 0 | 0 | 0 | 0 | 0 | 12.5 | 0 | 0 | 0 |
| MACEKOTE 512 | 0 | 0 | 0 | 0 | 0 | 0 | 0 | 12.5 | 0 | 0 |
| MACEKOTE 8538 | 0 | 0 | 0 | 0 | 0 | 0 | 0 | 0 | 12.5 | 0 |
| MACEKOTE 8539 | 0 | 0 | 0 | 0 | 0 | 0 | 0 | 0 | 0 | 12.5 |

The formulations were spray applied to phosphate treated steel test panels and tested in accordance with the jet fuel chemical resistance test described in MIL-L-23398. Formulation 12G showed some signs of delamination at the scribe lines. The other formulations showed no signs of delamination.

EXAMPLE 13

In this example, a formulation is prepared using morpholine to raise the pH of the system. The formulation, which had a final pH of 8.78, is provided in the following table. In the table, all amounts are in grams.

| | Amount |
|---|---|
| Deionized water | 64.95 |
| FOAMBAN 247 | 0.05 |
| DISPERBYK 190 | 4.5 |
| Molybdenum disulfide | 16 |
| Morpholine | 1 |
| BYK 346 | 1 |
| JONCRYL U4188 | 12.5 |

Thin films of this formulation showed signs of pigment separation. However, films dried with compressed air did not show such pigment separation.

EXAMPLE 14

In this example, ammonia was used to modify the pH and tested against formulations using morpholine. The formulations are provided in the following table. In the table, all amounts are in grams, unless otherwise stated.

| | 14A | 14B | 14C |
|---|---|---|---|
| Deionized water | 53.9 | 53.95 | 54 |
| FOAMBAN 247 | 0.05 | 0.05 | 0.05 |
| DISPERBYK 190 | 4.5 | 4.5 | 4.5 |
| Molybdenum disulfide | 16 | 16 | 0 |
| 28% ammonia | 8 drops | 0 | 0 |
| Morpholine | 0 | 1 | 0 |
| BYK 346 | 1 | 1 | 1 |
| DPnB | 5 | 5 | 5 |
| TPM | 5 | 5 | 5 |
| HYBRIDUR 570 | 12.5 | 12.5 | 12.5 |
| Final pH | 7.75 | Not tested | Not tested |

The initial pH of formulation 14A after molybdenum disulfide addition was 2.5. Addition of six drops of 28% ammonia raised the pH to 7. Formulations 14A-14C were sprayed onto a phosphate treated steel panel and subjected to corrosion testing pursuant to MIL-L-23398. Formulation 14A provided superior corrosion resistance properties relative to formulations 14B and 14C.

EXAMPLE 15

In this example, various resins were tested using TPM alone (without DPnB) as the coalescing agent. The formulations are provided in the following table. In the table, all amounts are in grams.

| | 15A | 15B | 15C | Masterbatch |
|---|---|---|---|---|
| Deionized water | 60.7 | 60.7 | 60.7 | 182.1 |
| FOAMBAN 247 | 0.05 | 0.05 | 0.05 | 0.15 |
| DISPERBYK 190 | 4.5 | 4.5 | 4.5 | 13.5 |
| Molybdenum disulfide | 16 | 16 | 16 | 48 |
| 28% ammonia | 0.25 | 0.25 | 0.25 | 0.75 |
| BYK 346 | 1 | 1 | 1 | 3 |
| TPM | 5 | 5 | 5 | 15 |
| HYBRIDUR 570 | 12.5 | 0 | 0 | 0 |
| REICHOLD SPENSOL F-97 | 0 | 12.5 | 0 | 0 |
| MACEKOTE 8539 | 0 | 0 | 12.5 | 0 |
| Final pH | 7.15 | 7.4 | 7.29 | N/A |

The formulations 15A, 15B, and 15C were made by adding 12.5 grams of the given resin to 87.5 gram aliquots of the masterbatch. The formulations were stable and provided a homogenous film upon spray application to phosphate treated steel panels. The formulations were subjected to corrosion testing using a salt fog test pursuant to MIL-L-23398. While these particular formulations did not pass the salt fog test, formulations 15A and 15B showed substantially better corrosion resistance than Formulation 15C.

EXAMPLE 16

In this example, a mixture of resins was employed. The formulation included deionized water, 71.18 g; BYK 028, 0.01 g, ammonia; 0.3 g; molybdenum disulfide, 16 g; MACEKOTE 8539, 9 g; SPENSOL F-97, 3 g; ENVIROGEM AE-01, 0.5 g; and manganese hydrocure, 0.01 g. The resulting formulation was stable, sprayable, and formed a homogenous film upon application to phosphate treated steel test panels. While the formulation did not meet the performance requirements of MIL-L-23398, the formulation did provide corrosion resistance.

EXAMPLE 17

In this example, another resin was used. The formulations are provided in the following table. In the table, all amounts are in grams.

| | 17A |
|---|---|
| Deionized water | 54.2 |
| BYK 028 | 0.5 |
| Ammonia | 0.3 |
| Molybdenum disulfide | 16 |
| JONCRYL 1550 | 12.5 |
| JONCRYL U4188 | 0 |
| TPM | 6 |
| DPnB | 10 |
| AE-01 | 0.5 |

Formulation 17A was stable, sprayable, and formed a homogenous (monolithic) film coating when sprayed onto a phosphate treated steel test panel. The sprayed test panels were subjected to corrosion resistance testing according to MIL-L-23398. The film provided corrosion resistance but this particular formulation did not meet the performance requirements of MIL-L-23398.

EXAMPLE 18

In this example, the amount of resin was increased to evaluate corrosion resistance of the resulting formulation. The formulation contained: JONCRYL U4188, 35 g; molybdenum disulfide, 5 g; Deionized water, 43.19 g; TPM, 6 g; BYK 028, 0.01 g; DPnB, 10 g; ENVIROGEM AE-01, 0.5 g; and ammonia, 0.3 g. The resulting formulation had a pH of 8.62.

The formulation was stable and when sprayed formed a homogenous film. The formulation was spray applied to a phosphate treated steel panel and cured for 24 hours at 70 degrees Centigrade, and then tested according to MIL-L-23398. No corrosion was observed after 100 hours in the salt fog bath. No blisters were observed for the duration of the test. This formulation passed the MIL-L-23398 protocol.

EXAMPLE 19

In this example, the formulation was designed to balance corrosion protection with lubricant endurance life. The formulations are provided in the following table. In the table, all amounts are in grams.

| | 19A | 19B | 19C |
|---|---|---|---|
| JONCRYL U4188 | 25 | 27 | 30 |
| Molybdenum disulfide | 15 | 17 | 18 |
| Deionized water | 43.19 | 39.19 | 35.19 |
| TPM | 6 | 6 | 6 |
| BYK 028 | 0.01 | 0.01 | 0.01 |
| DPnB | 10 | 10 | 10 |
| AE-01 | 0.5 | 0.5 | 0.5 |
| Ammonia | 0.3 | 0.3 | 0.3 |
| final pH | 8.38 | 8.29 | 8.33 |

The formulations were stable and formed a homogenous film upon spraying. The formulations were spray applied to phosphate treated test panels and cured at room temperature for 1 to 2 hours, then 20 hours at 70 degrees Centigrade. The panels were put in a salt fog chamber. While corrosion resistance was provided by these formulations, moderate to heavy corrosion was observed after 100 hours.

EXAMPLE 20

In this example, resin and molybdenum disulfide amounts are varied. The formulations are provided in the following table. In the table, all amounts are in grams.

| | 20A | 20B | 20C | 20D |
|---|---|---|---|---|
| JONCRYL U4188 | 35 | 35 | 35 | 35 |
| Molybdenum disulfide | 7 | 9 | 11 | 13 |
| Deionized water | 41.19 | 39.19 | 37.19 | 35.19 |
| TPM | 6 | 6 | 6 | 6 |
| BYK 028 | 0.01 | 0.01 | 0.01 | 0.01 |
| DPnB | 10 | 10 | 10 | 10 |
| AE-01 | 0.5 | 0.5 | 0.5 | 0.5 |
| Ammonia | 0.3 | 0.3 | 0.3 | 0.3 |
| final pH | 8.39 | 8.31 | 7.99 | 7.84 |

The formulations were stable and formed homogenous films upon spray application. The formulations were spray applied to a phosphate treated steel panel, cured at 70 degrees Centigrade for 20 hours, then placed into a salt fog chamber. While each formulation provided some level of corrosion resistance in the MIL-L-23398 test procedure, after 144 hours moderate corrosion was observed with some blistering. Formulation 20C provided superior results to the other formulations.

EXAMPLE 21

In this example, the amount of resin and molybdenum disulfide were varied. The formulations are provided in the following table. In the table, all amounts are in grams.

| | 21A | 21B | 21C | 21D |
|---|---|---|---|---|
| JONCRYL U4188 | 33 | 31 | 29 | 27 |
| Molybdenum disulfide | 7 | 9 | 11 | 13 |
| Deionized water | 43.19 | 43.19 | 43.19 | 43.19 |
| TPM | 6 | 6 | 6 | 6 |
| BYK 028 | 0.01 | 0.01 | 0.01 | 0.01 |
| DPnB | 10 | 10 | 10 | 10 |
| AE-01 | 0.5 | 0.5 | 0.5 | 0.5 |
| Ammonia | 0.3 | 0.3 | 0.3 | 0.3 |
| final pH | 8 | 7.95 | 7.86 | 7.86 |

The formulations were stable and formed homogenous films upon spraying. While all the formulations provided some level of corrosion resistance, corrosion was observed in the steel panels using MIL-L-23398 after 144 hours.

EXAMPLE 22

In this example, resin and molybdenum disulfide amounts were modified. The formulations are provided in the following table. In the table, all amounts are in grams.

| | 22A | 22B |
|---|---|---|
| JONCRYL U4188 | 37 | 40 |
| Molybdenum disulfide | 20 | 20 |
| Deionized water | 26.19 | 23.19 |
| TPM | 6 | 6 |
| BYK 028 | 0.01 | 0.01 |
| DPnB | 10 | 10 |
| AE-01 | 0.5 | 0.5 |
| Ammonia | 0.3 | 0.3 |

The formulations were stable and formed a homogenous film upon spray application. While formulation 22A provided some corrosion resistance, moderate to heavy corrosion was observed using the MIL-L-23398 test protocol after 100 hours. By contrast, formulation 22B provided excellent corrosion resistance with no corrosion observed on the test panel.

EXAMPLE 23

In this example, the composition contains a lower level of DPnB relative to example 22 in an effort to improve long-term shelf life stability. The formulation is provided in the following table. In the table, all amounts are in grams.

| | |
|---|---|
| Deionized water | 32.19 |
| BYK 028 | 0.01 |
| Molybdenum disulfide | 21 |
| JONCRYL U4188 | 35 |
| Ammonia | 0.3 |
| AE-01 | 0.5 |
| TPM | 6 |
| DPnB | 5 |

The first six materials were added and blended. TPM was then added with stirring. DPnB was then added with stirring. The resulting formulation did not increase in viscosity with addition of the DPnB. The formulation was stable and formed a homogenous film when spray applied. The final formulation had improved long-term shelf life stability relative to the formulations in example 22 (did not increase in viscosity when aged at room temperature).

EXAMPLE 24

In this example, a formulation using tap water was compared to a formulation using deionized water.

| | 24A | 24B |
|---|---|---|
| Tap water | 43.58 | 0 |
| Deionized water | 0 | 43.58 |
| BYK 038 | 0.012 | 0.012 |
| Molybdenum disulfide | 19.92 | 19.92 |
| Ammonia | 0.37 | 0.37 |
| JONCRYL U4188 | 15.56 | 15.56 |
| AE-01 | 0.62 | 0.62 |
| TPM | 7.47 | 7.47 |
| DPnB | 12.45 | 12.45 |

It was found that when DPnB was added with mixing to formulation 24A, the viscosity became too high to spray.

EXAMPLE 25

In this example, TEFLON powder and varying ratios of TPM and DPnB were used. The formulations are provided in the following table. In the table, all amounts are in grams.

| | 25A | 25B |
|---|---|---|
| Deionized water | 40.2 | 43.2 |
| Ammonia | 0.3 | 0.3 |
| JONCRYL U4188 | 22 | 20 |
| Molybdenum disulfide | 21 | 18 |
| TEFLON powder | 5 | 5 |
| AE-01 | 0.5 | 0.5 |
| TPM | 6 | 6 |
| DPnB | 5 | 7 |

The formulations were stable, provided corrosion resistance, passed the lubrication endurance test, and formed a homogenous stable film upon spray application. The formulations passed the corrosion resistance and endurance life testing according to MIL 23398.

EXAMPLE 26

In this example, an alternative cosolvent (coalescing agent) ratio was employed. The formulations are provided in the following table. In the table, all amounts are in grams.

| | 26A |
|---|---|
| Deionized water | 543.8 (27.19%) |
| ENVIROGEM AE-01 | 10 (0.5%) |
| BYK 028 | 0.2 (0.01%) |
| Molybdenum disulfide | 420 (21%) |
| Ammonia | 6 (0.3%) |
| JONCRYL U4188 | 700 (35%) |
| TPM | 120 (6%) |
| DPnB | 200 (10%) |

The first five components were blended using a high shear blade mixer at 1000 rpm for 10 minutes. The resin (JONCRYL U4188) was then slowly charged to the mixer. These components were mixed for one hour. The TPM and DPnB were then sequentially added to the pail with stirring, then mixed for about 30 minutes at 1000 rpm. After mixing, the product was a whipped paste. Additional deionized water was added in 25 gram aliquots to reduce the viscosity to form a sprayable mixture.

What is claimed is:

1. A water-based lubricant composition, comprising: water, molybdenum disulfide, polytetrafluoroethylene, ammonia in an amount up to 1 percent by weight, and a polymeric binder, wherein the binder is an acrylic resin or a polyurethane resin and wherein the composition has a pH in the range of 7 to 11.

2. The composition of claim 1, further comprising a surfactant.

3. The composition of claim 1, further comprising at least one coalescing agent.

4. The composition of claim 1, wherein the binder is an aliphatic polyurethane resin.

5. The composition of claim 1, further comprising tripropylene glycol monomethyl ether and dipropylene glycol butyl ether.

6. The composition of claim 1, further comprising a dispersing agent.

7. The composition of claim 1, further comprising an antifoaming agent.

8. The composition of claim 1, wherein the composition has a pH in the range of 7 to 10.

9. The composition of claim 1, wherein the composition has a pH in the range from 8 to 10.

10. The composition of claim 1, wherein the water is present in an amount of from 20 to 60 percent by weight based on the total weight of the composition.

11. The composition of claim 1, wherein the molybdenum disulfide is present in an amount of from 0.1 to 50 percent by weight based on the total weight of the composition.

12. The composition of claim 1, wherein the binder is present in an amount of from 5 to 50 by weight based on the total weight of the composition.

13. The composition of claim 1, wherein the polytetrafluoroethylene is present in an amount of from 0.1 to 10 percent by weight based on the total weight of the composition.

14. A water-based lubricant composition, comprising: 20 to 60 percent of water, 0.1 to 50 percent of molybdenum disulfide, 0.1 to 10 percent polytetrafluoroethylene, 5 to 50 percent of an aliphatic polyurethane binder, 0.1 to 1 percent of ammonia, at least one glycol ether coalescing agent, wherein the composition has a pH in the range from 8 to 10.

15. A process for the manufacture of a water-based lubricant composition, comprising:

combining water, molybdenum disulfide, polytetrafluoroethylene, ammonia in an amount up to 1 percent by weight, and a polymeric binder to form the water-based lubricant composition, wherein the binder is an acrylic resin or a polyurethane resin and wherein the pH of the water-based composition is between 7 and 11 prior to combining the polymeric binder.

16. The process of claim 15, wherein the molybdenum disulfide is combined prior to the polymeric binder.

17. The process of claim 15, wherein the polymeric binder is combined prior to the molybdenum disulfide.

18. The process of claim 15, wherein the water-based composition further comprises at least one coalescing agent.

19. The process of claim 15, wherein the water-based composition further comprises at least one surfactant.

20. The process of claim 15, wherein the binder is an aliphatic polyurethane resin.

21. The process of claim 15, wherein the water-based composition further comprises tripropylene glycol monomethyl ether and dipropylene glycol butyl ether.

22. The process of claim 15, wherein the water-based composition further comprises a dispersing agent.

23. The process of claim 15, wherein the water-based composition further comprises an antifoaming agent.

24. The process of claim 15, wherein the water is present in an amount of from 20 to 60 percent by weight based on the total weight of the composition.

25. The process of claim 15, wherein the molybdenum disulfide is present in an amount of from 0.1 to 50 percent by weight based on the total weight of the composition.

26. The process of claim 15, wherein the binder is present in an amount of from 5 to 50 by weight based on the total weight of the composition.

27. The process of claim 15, wherein the polytetrafluoroethylene is present in an amount of from 0.1 to 10 percent by weight based on the total weight of the composition.

28. A process of coating a metal surface with a lubricant, comprising:

applying a water-based lubricant composition to the metal surface, wherein the water-based composition comprises water, molybdenum disulfide, polytetrafluoroethylene, ammonia in an amount up to 1 percent by weight, and a polymeric binder, wherein the binder is an acrylic resin or a polyurethane resin and wherein the pH of the water-based composition is between 7 and 11 prior to combining the polymeric binder;

allowing water and any volatile components of the water-based lubricant composition to evaporate to thereby form a coating on the metal surface.

29. The process of claim 28, wherein the molybdenum disulfide is combined prior to the polymeric binder.

30. The process of claim 28, wherein the polymeric binder is combined prior to the molybdenum disulfide.

31. The process of claim 28, wherein the water-based composition further comprises at least one coalescing agent.

32. The process of claim 28, wherein the water-based composition further comprises at least one surfactant.

33. The process of claim 28, wherein the binder is an aliphatic polyurethane resin.

34. The process of claim 28, wherein the water-based composition further comprises tripropylene glycol monomethyl ether and dipropylene glycol butyl ether.

35. The process of claim 28, wherein the water-based composition further comprises a dispersing agent.

36. The process of claim 28, wherein the water-based composition further comprises an antifoaming agent.

37. The process of claim 28, wherein the water is present in the water-based composition in an amount of from 20 to 60 percent by weight based on the total weight of the composition.

38. The process of claim 28, wherein the molybdenum disulfide is present in the water-based composition in an amount of from 0.1 to 50 percent by weight based on the total weight of the composition.

39. The process of claim 28, wherein the binder is present in the water-based composition in an amount of from 5 to 50 by weight based on the total weight of the composition.

40. The process of claim 28, wherein the polytetrafluoroethylene is present in the water-based composition in an amount of from 0.1 to 10 percent by weight based on the total weight of the composition.

41. A metal fastener coated with the residue formed by evaporation of volatile components of a water-based composition comprising water, an acrylic or urethane resin, molybdenum disulfide, ammonia in an amount up to 1 percent, and polytetrafluoroethylene, and wherein the composition has a pH in the range of 7 to 11.

42. The fastener of claim 41, wherein the water-based composition further comprises a surfactant.

43. The fastener of claim 41, wherein the water-based composition further comprises at least one coalescing agent.

44. The fastener of claim 41, wherein the binder is an aliphatic polyurethane resin.

45. The fastener of claim 41, wherein the water-based composition further comprises tripropylene glycol monomethyl ether and dipropylene glycol butyl ether.

46. The fastener of claim 41, wherein the water-based composition further comprises a dispersing agent.

47. The fastener of claim 41, wherein the water-based composition further comprises an antifoaming agent.

48. The fastener of claim 41, wherein the composition has a pH in the range of 7 to 10.

49. The fastener of claim 41, wherein the composition has a pH in the range from 8 to 10.

50. The fastener of claim 41, wherein the water is present in the water-based composition in an amount of from 20 to 60 percent by weight based on the total weight of the composition.

51. The fastener of claim 41, wherein the molybdenum disulfide is present in the water-based composition in an amount of from 0.1 to 50 percent by weight based on the total weight of the composition.

52. The fastener of claim 41, wherein the binder is present in the water-based composition in an amount of from 5 to 50 by weight based on the total weight of the composition.

53. The fastener of claim 41, wherein the polytetrafluoroethylene is present in the water-based composition in an amount of from 0.1 to 10 percent by weight based on the total weight of the composition.

* * * * *